US007965248B2

(12) United States Patent
Chou et al.

(10) Patent No.: US 7,965,248 B2
(45) Date of Patent: Jun. 21, 2011

(54) DUAL-FEED AND DUAL-BAND ANTENNA

(75) Inventors: Jui-Hung Chou, Taichung (TW); Saou-Wen Su, Taipei (TW)

(73) Assignees: Silitek Electronic (Guangzhou) Co., Ltd., Guangzhou (CN); Lite-One Technology Corporation, Taipei (TW)

( * ) Notice: Subject to any disclaimer, the term of this patent is extended or adjusted under 35 U.S.C. 154(b) by 50 days.

(21) Appl. No.: 12/216,726

(22) Filed: Jul. 10, 2008

(65) Prior Publication Data

US 2009/0251381 A1 Oct. 8, 2009

(30) Foreign Application Priority Data

Apr. 8, 2008 (CN) ..... 2008 1 0089213

(51) Int. Cl.
*H01Q 1/38* (2006.01)
*H01Q 5/01* (2006.01)

(52) U.S. Cl. ..... 343/725; 343/702; 343/830; 343/841

(58) Field of Classification Search ..... 343/700 MS, 343/702, 846, 795, 830, 841, 789, 725, 828, 343/829, 893
See application file for complete search history.

(56) References Cited

U.S. PATENT DOCUMENTS

| | | | | |
|---|---|---|---|---|
| 6,624,789 | B1 * | 9/2003 | Kangasvieri et al. | 343/702 |
| 2007/0146210 | A1 * | 6/2007 | Hilgers | 343/702 |
| 2009/0009401 | A1 * | 1/2009 | Suzuki et al. | 343/700 MS |
| 2009/0153404 | A1 * | 6/2009 | Ryou et al. | 343/700 MS |

* cited by examiner

*Primary Examiner* — Michael C. Wimer
(74) *Attorney, Agent, or Firm* — Rosenberg, Klein & Lee

(57) ABSTRACT

A dual-feed and dual-band antenna includes a substrate, a grounding unit disposed on the substrate and having two opposite sides, a first radiating unit disposed on the substrate near the first side of the grounding unit, and a second radiating unit disposed on the substrate near the second side. The second radiating unit has a short-circuit strip electrically connected to the grounding unit. The antenna further includes a first coaxial cable electrically connected to the first radiating unit and the grounding unit, and a second coaxial cable electrically connected to the second radiating unit and the grounding unit.

18 Claims, 6 Drawing Sheets

DUAL-FEED AND DUAL-BAND ANTENNA

BACKGROUND OF THE INVENTION

1. Field of the Invention

The present invention relates to a dual-feed and dual-band antenna. The invention in particular relates to a dual-band antenna structure operating in two frequency bands of a wireless network.

2. Description of Prior Art

Because of the improvement of wireless communication technology, electronic products increasingly require high quality reception of signals. Antennas are the necessary parts in the communication device and the efficiency of the antenna is an important factor for wireless communication quality. Different kinds of antennas of wireless communication systems have different performance requirements according to different applications, and now the antenna technology is improving to wideband and small-size applications.

Wireless communication systems including cell phones, the global positioning system (GPS), digital TV, multi input and multi output (MIMO), etc. transmit and receive data by means of antennas. The wireless communication industry requires electronic products to be light, thin, low power-consuming, small, and have highly integrated ICs to achieve miniaturization. Depending on different applications, engineers focus on designing antennas to meet requirements in any situation.

However, the traditional dual-band antenna is usually with a single-feed, so a switch circuit is necessary to separate two different operation bands. The switch circuit reduces the antenna gain and bandwidth. On the other hand, a plastic base is used for assembling two antennas of different operation bands. The manufacturing processes of the plastic base are very complex and thus increase production costs.

Therefore, in view of this, the inventor proposes the present invention to overcome the above problems based on his expert experience and deliberate research.

SUMMARY OF THE INVENTION

The primary object of the present invention is to provide a dual-feed and dual-band antenna. The dual-feed and dual-band antenna can be applied in two operation bands in order to satisfy multi-module application.

The further object of the present invention is to provide a dual-feed and dual-band antenna with simplified structures and the size of the electronic device having the antenna can be further reduced.

In order to achieve the above objects, the present invention provides a dual-feed and dual-band antenna, comprising: a substrate; a grounding unit disposed on the substrate wherein the grounding unit has a first and a second sides; a first radiating unit disposed on the substrate and at the first side of the grounding unit; and a second radiating unit disposed on the substrate and at the second side of the grounding unit, wherein the second radiating unit has a short-circuit strip electrically connected to the grounding unit.

In order to achieve the above objects, the present invention provides a dual-feed and dual-band antenna, comprising: a substrate having a top surface and a bottom surface; a grounding unit selectively disposed on the top surface or the bottom surface of the substrate and having a first side and a second side; a first radiating unit selectively disposed on the top surface or the bottom surface of the substrate and at the first side of the grounding unit; a second radiating unit selectively disposed on the top surface or the bottom surface of the substrate and at the second side of the grounding unit, wherein the second radiating unit has a short-circuit strip electrically connected to the grounding unit; a first coaxial cable connected between the grounding unit and the first radiating unit; and a second coaxial cable connected between the grounding unit and the second radiating unit.

The switch circuit of the traditional antenna is not necessary for the dual-feed and dual-band antenna of the present invention. Thus the size of the communication device is further reduced. The performance of the dual feed and dual-band antenna is qualified in the operation of two bands and the two bands do not interfere with each other.

In order to better understand the characteristics and technical contents of the present invention, a detailed description thereof will be made with reference to accompanying drawings. However, it should be understood that the drawings and the description are illustrative but not used to limit the scope of the present invention.

DETAILED DESCRIPTION OF THE INVENTION

Figure 1:
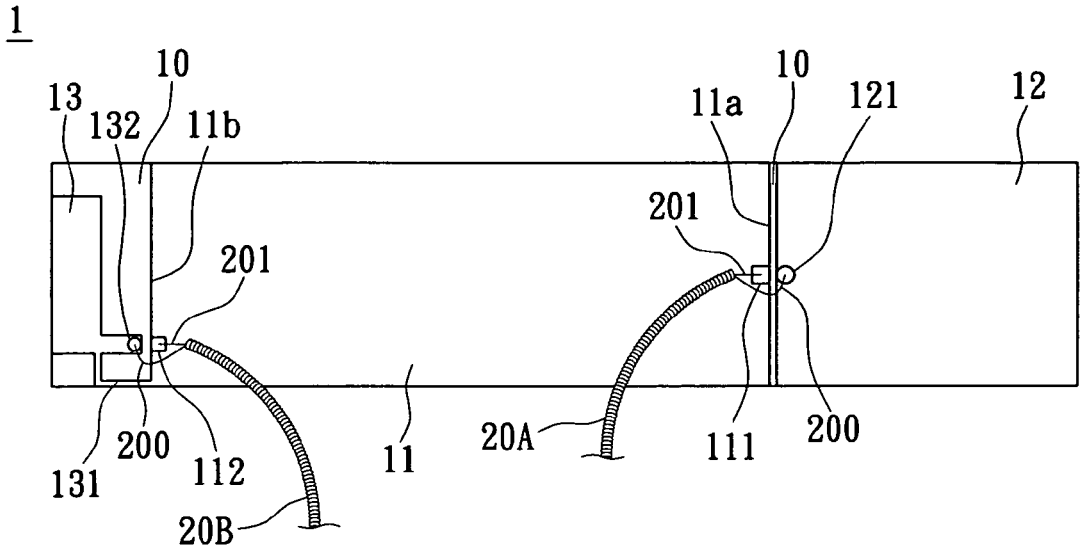
FIG. 1 shows the first embodiment of the dual-feed and dual-band antenna according to the present invention.

Please refer to FIG. 1, the invention discloses a dual-feed and dual-band antenna 1 including a substrate 10, a grounding unit 11, a first radiating unit 12, and a second radiating unit 13. The grounding unit 11 is disposed on the substrate 10 and the grounding unit 11 has a first side 11*a* and a second side 11*b*. The first radiating unit 12 is disposed on the substrate 10 in close proximity to the first side 11*a* of the grounding unit 11. The second radiating unit 13 is disposed on the substrate 10 in close proximity to the second side 11*b* of the grounding unit 11. The second radiating unit 13 has a short-circuit strip 131 electrically connected to the grounding unit 11. Furthermore, the dual-feed and dual-band antenna 1 has a first coaxial cable 20A connected with the grounding unit 11 and the first radiating unit 12 and a second coaxial cable 20B connected with the grounding unit 11 and the second radiating unit 13. The first radiating unit 12 and the second radiating unit 13 can operate in a first and a second operation band, respectively. The first and the second operation bands can be of the same frequency or of different frequencies. In the embodiment, the first and the second operation bands are respectively the 2.4 GHz frequency band and the 5 GHz frequency band.

Figure 1A:
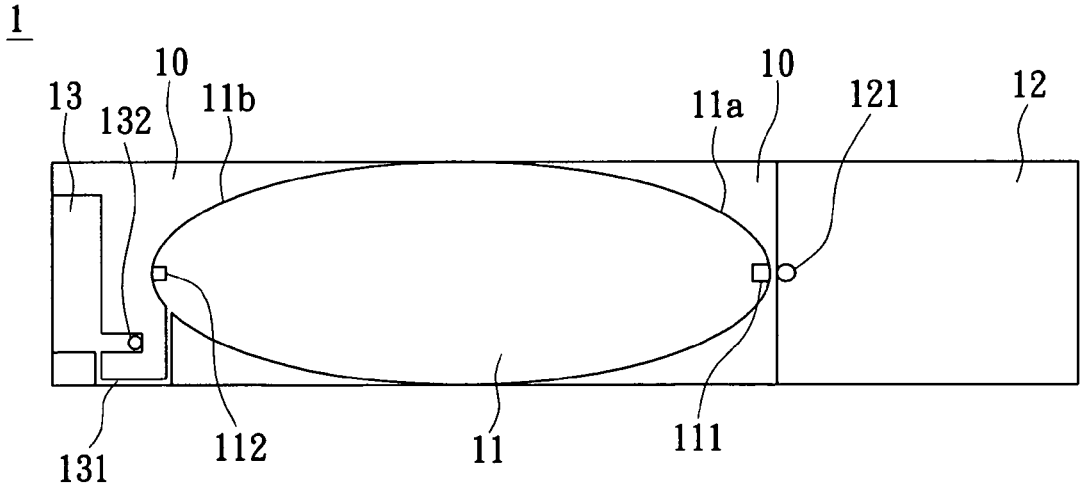
FIG. 1A shows the second embodiment of the dual-feed and dual-band antenna according to the present invention.
Figure 1B:
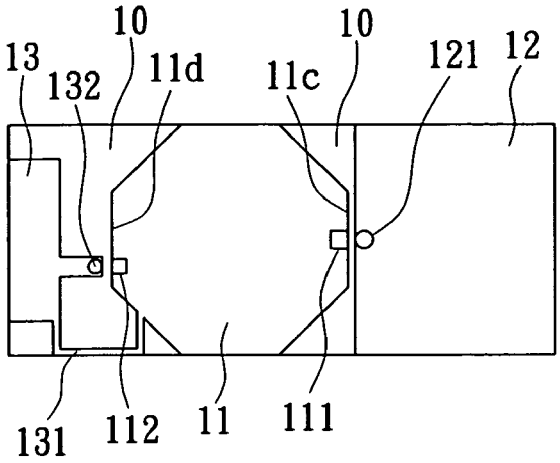
FIG. 1B shows the third embodiment of the dual-feed and dual-band antenna according to the present invention.

The first radiating unit 12 and the second radiating unit 13 are respectively formed near opposite sides of the grounding unit 13, i.e., the first side 11*a* and the second side 11*b* of the grounding unit 11. The grounding unit 11 can be of any kind of shape. For example, the grounding unit 11 has a four-sided shape, such as rectangle, square, parallelogram, and rhombus. In FIG. 1, a rectangular grounding unit 11 is shown as the first embodiment. The first radiating unit 12 and the second radiating unit 13 are respectively formed in close proximity to the two shorter sides of the rectangular grounding unit 11, i.e., the first side 11*a* and the second side 11*b* of the grounding unit 11 in this embodiment. However, the first radiating unit 12 and the second radiating unit 13 can be respectively formed in close proximity to the two longer sides of the grounding unit 11 under the condition that the area of the grounding unit 11 is smaller than half the wavelength of the lower frequency band. Alternatively, the grounding unit 11 can be circular or elliptical. In FIG. 1A, an elliptical grounding unit 11 is shown as the second embodiment. In this embodiment, the elliptical grounding unit 11 has a long axis and a short axis and the first radiating unit 12 and the second radiating unit 13 are formed in close proximity to the ends of the long axis. However, the first radiating unit 12 and the second radiating unit 13 can also be formed in close proximity to the ends of the shorter axis under the condition that the area of the grounding unit 11 is smaller than half the wavelength of the lower frequency band. On the other hand, the present invention further defines a predetermined axis and the first radiating unit 12 and the second radiating unit 13 can be formed near the ends of the predetermined axis in the limitation of the area of the grounding unit 11, i.e., the area of the grounding unit 11 is smaller than half the wavelength of the lower frequency band. The third embodiment is shown in FIG. 1B, and the grounding unit 11 can be a polygonal structure (a hexagonal grounding unit 11 is shown in FIG. 1B). The first radiating unit 12 and the second radiating unit 13 are formed in close proximity to the opposite sides 11*c* and 11*d* of the grounding unit 11. In other words, grounding unit 11 can be a polygonal structure having at least four sides (such as hexagon, octagon, and so on) and the first radiating unit 12 and the second radiating unit 13 are disposed in close proximity to two opposite sides of the polygonal grounding unit 11.

The first radiating unit 12 has a first feeding point 121 and the grounding unit 11 has a first grounding point 111 on the first side 11*a* corresponding to the first feeding point 121. The first coaxial cable 20A connects with the first grounding point 111 and the first feeding point 121. Please refer to FIG. 1, the first coaxial cable 20A has a central conductor 200 and an outer grounding conductor 201 and the central conductor 200 and the outer grounding conductor 201 of the first coaxial cable 20A are respectively connected to the first feeding point 121 and the first grounding point 111.

Moreover, the second radiating unit 13 is formed in close proximity to the second side 11*b* of the grounding unit 11. The second radiating unit 13 has a short-circuit strip 131 electrically connected to the grounding unit 11 and a second feeding point 132. The grounding unit 11 has a second grounding point 112 corresponding to the second feeding point 132. Similarly, the second coaxial cable 20B has a central conductor 200 and an outer grounding conductor 201. The central conductor 200 and the outer grounding conductor 201 of the second coaxial cable 20B are respectively connected to the second feeding point 132 and the second grounding point 112. Moreover, the second radiating unit 13 and the short-circuit strip are formed at least one angle. For example, the second radiating unit 13 and the short-circuit strip 131 are form to L-shape.

The dual-feed and dual-band antenna 1 can resonate a first band (i.e. a lower frequency band), and a second band (i.e. a higher frequency band). In the embodiment, the first band can be ranged between 2400 to 2484 MHz and the second band can be ranged between 5150 to 5825 MHz. The size of the dual-feed and dual-band antenna 1 can be reduced by the short-circuit strip 131.

On the other hand, the dual-feed and dual-band antenna 1 can perform the communication with small-area grounding unit 11. On the contrary, the traditional antenna must be with a large grounding unit. In the embodiment, the size of the grounding unit 11 is preferably smaller than the half wavelength of the lower frequency band so that the size of the dual-feed and dual-band antenna 1 is reduced and the size of the electronic device having the dual-feed and dual-band antenna 1 can be further reduced.

Figure 2:
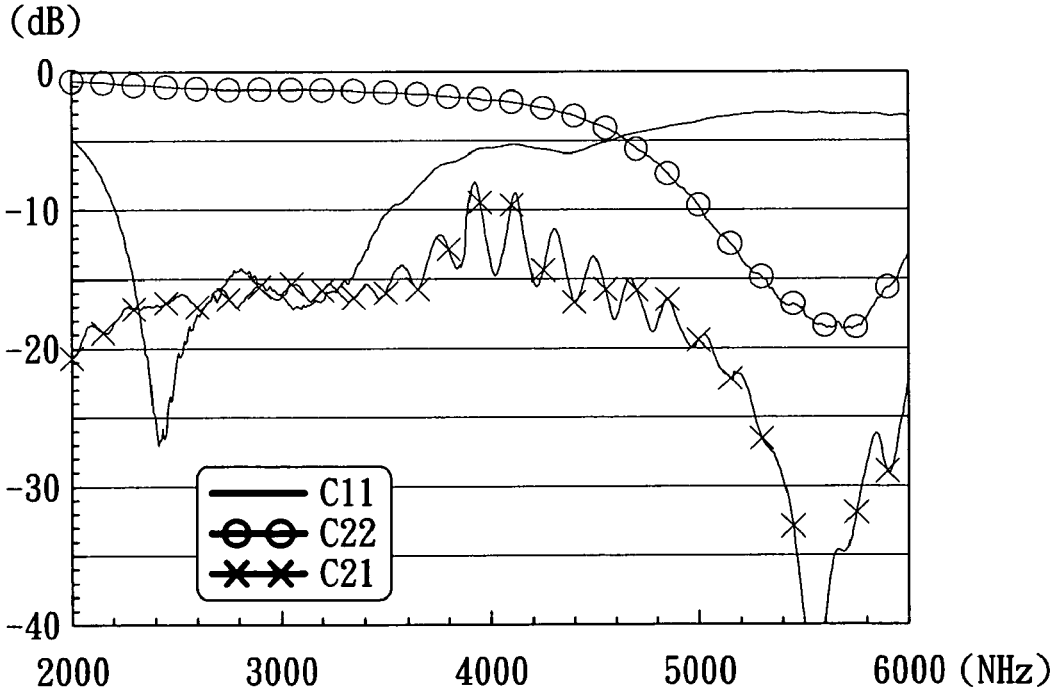
FIG. 2 shows the experimental data of the dual-feed and dual-band antenna according to the present invention.
Figure 3:
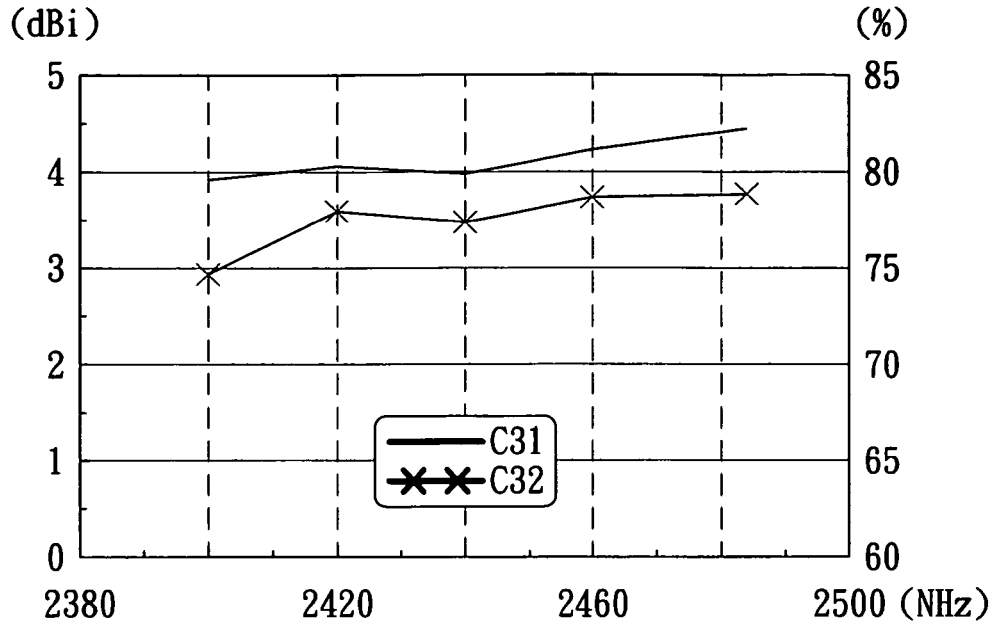
FIG. 3 shows data of gain and radiating efficiency of the dual-feed and dual-band antenna performing in the 2.4 GHz band.
Figure 4:
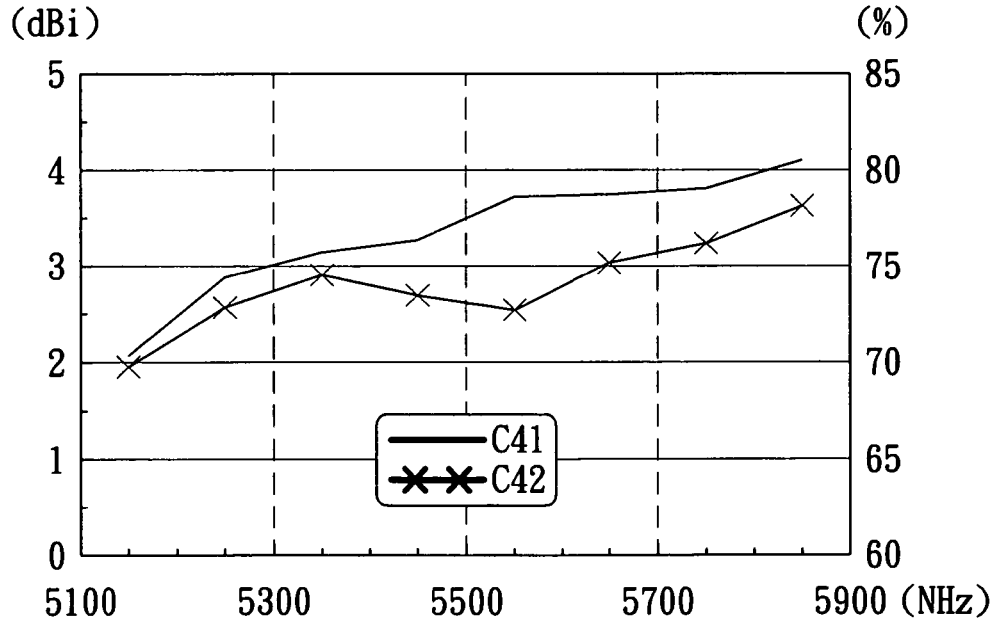
FIG. 4 shows data of gain and radiating efficiency of the dual-feed and dual-band antenna performing in the 5 GHz band.

Please refer to FIGS. 2-4, the experiment data of the performance of the dual-feed and dual-band antenna 1 are shown. In FIG. 2, line C11 and C22 respectively present the performance in low-band and in high-band of the dual-feed and dual-band antenna 1 and line C21 shows the isolation. Generally speaking, when the impedance bandwidth of the antenna is smaller than −10 dB, it's believed that the antenna is qualified to perform the transmission and reception. As shown in FIG. 2, line C11 and C22 respectively shows the impedances of the dual-feed and dual-band antenna 1 in 2400-2484 MHz and 5150-5825 MHz are smaller than −10 dB. The line C21 shows that the isolation is smaller than −15 dB and the two band performances of the dual-feed and dual-band antenna 1 are good isolated. Accordingly, the dual-feed and dual-band antenna 1 can operate well in the two frequency bands and will not interfere with each other. Please refer to FIG. 3, the gain and the radiating efficiency of the dual-feed and dual-band antenna 1 in low-band are shown. Line C31 shows the gain of the dual-feed and dual-band antenna 1 is greater than 4 dBi in low-band and line C32 shows the radiating efficiency of the dual-feed and dual-band antenna 1 is greater than 75% in low-band. FIG. 4 shows the gain and the radiating efficiency of the dual-feed and dual-band antenna 1 in high-band. Line C41 shows the gain of dual-feed and dual-band antenna 1 is between 2-4 dBi in high-band and line C42 shows the radiating efficiency of the dual-feed and dual-band antenna 1 is between 70-80% in high-band. Therefore, either the performance of the dual-feed and dual-band antenna 1 in low-band or in high-band is qualified for signal transmission and reception.

Figure 5:
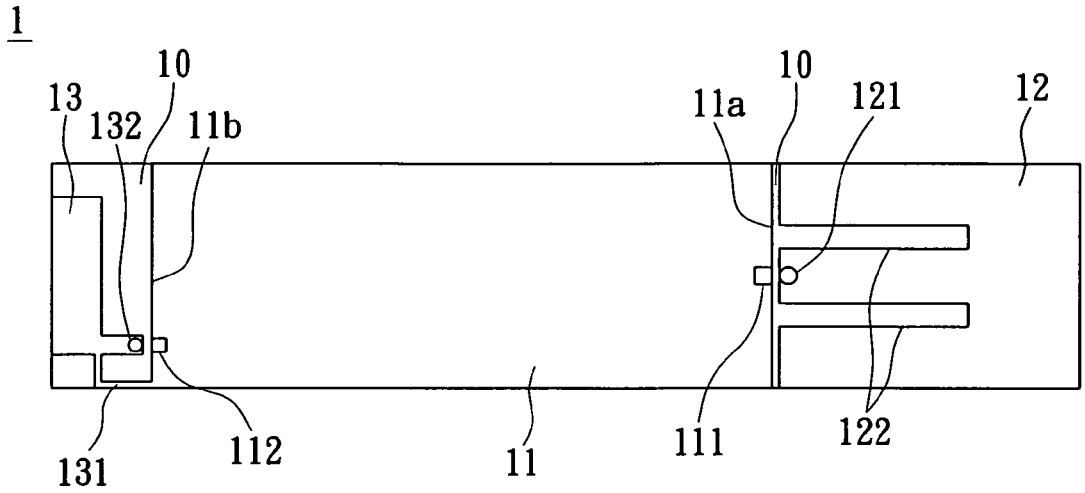
FIG. 5 shows the fourth embodiment of the dual-feed and dual-band antenna according to the present invention.
Figure 5A:
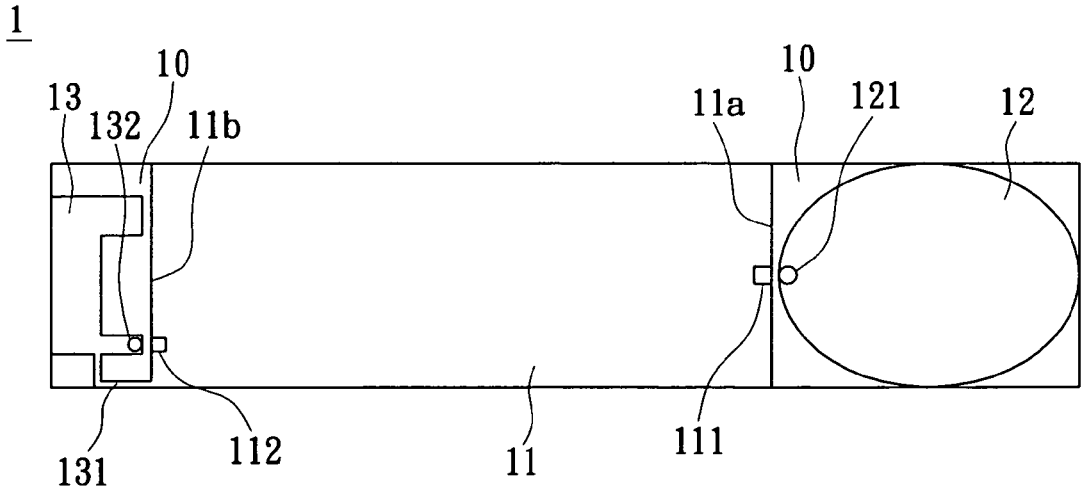
FIG. 5A shows the fifth embodiment of the dual-feed and dual-band antenna according to the present invention.
Figure 5B:
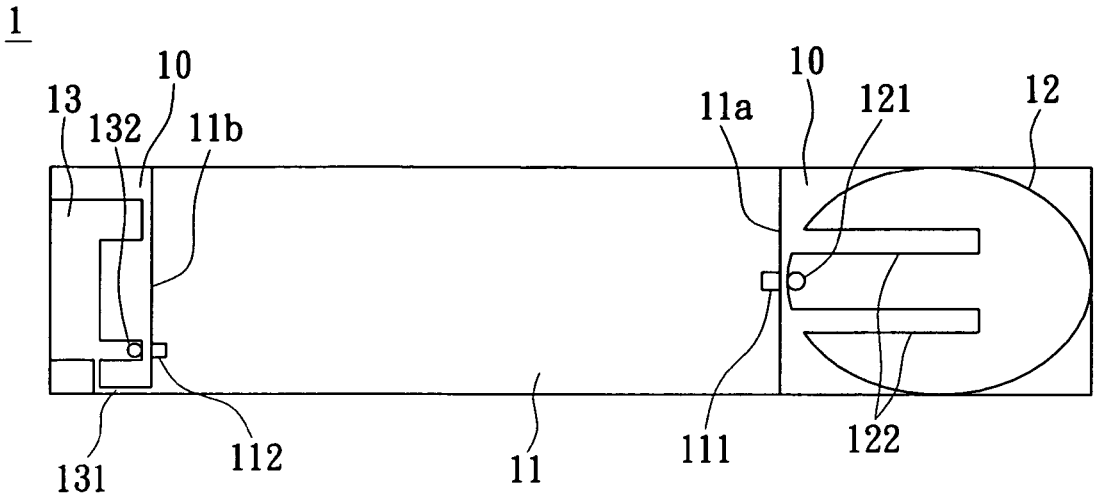
FIG. 5B shows the sixth embodiment of the dual-feed and dual-band antenna according to the present invention.
Figure 5C:
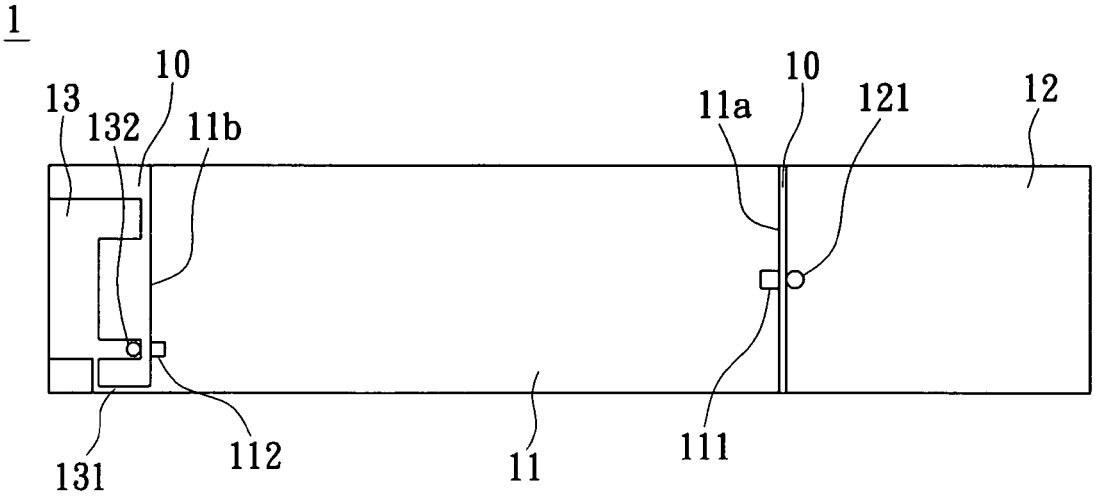
FIG. 5C shows the seventh embodiment of the dual-feed and dual-band antenna according to the present invention.

FIG. 5 shows the fourth embodiment of the dual-feed and dual-band antenna 1. The first radiating unit 12 has at least one slot 122 (two slots 122 are illustrated in this embodiment) and the size of the dual-feed and dual-band antenna 1 can further reduced by forming the slots 122. FIG. 5A shows the fifth embodiment of the dual-feed and dual-band antenna 1. The first radiating unit 12 is substantially elliptical. The second radiating unit 13 has two angles and forms a traverse U-shape. FIG. 5B shows the sixth embodiment and two slots 122 are formed on the first radiating unit 12 and the remaining parts are equivalent to the fifth embodiment. FIG. 5C shows the seventh embodiment and the dual-feed and dual-band antenna 1 has a substantially rectangular radiating unit 12 and a second radiating unit 13 with two angular structures (traverse U-shape). The above-described embodiments are illustrated for presenting the practice application, but the present invention is not restricted to these embodiments.

Moreover, the grounding unit 11, the first radiating unit 12 and the second radiating unit 13 can be selectively disposed on different surfaces of the substrate 10. In other words, the dual-feed and dual-band antenna 1 can be a non-coplanar antenna structure. Therefore, the dual-feed and dual-band antenna 1 includes a substrate 10, a grounding unit 11, a first radiating unit 12, and a second radiating unit 13. The grounding unit 11 is selectively disposed on the substrate 10 and the grounding unit 11 has a first side 11*a* and a second side 11*b*. The first radiating unit 12 is selectively disposed on the substrate 10 in close proximity to the first side 11*a* of the grounding unit 11. The second radiating unit 13 is selectively disposed on the substrate 10 in close proximity to the second side 11*b* of the grounding unit 11. The second radiating unit 13 has a short-circuit strip 131 electrically connected to the grounding unit 11. Furthermore, the dual-feed and dual-band antenna 1 has a first coaxial cable 20A connected between the grounding unit 11 and the first radiating unit 12 and a second coaxial cable 20B connected between the grounding unit 11 and the second radiating unit 13. The first radiating unit 12 and the second radiating unit 13 can resonate a first and a second operation bands. Please note the first and the second operation bands can be the same frequency or not. The remaining structures, such as the first feeding point 121, the first grounding point 111 and so on are equivalent to the above embodiments.

Figure 6:
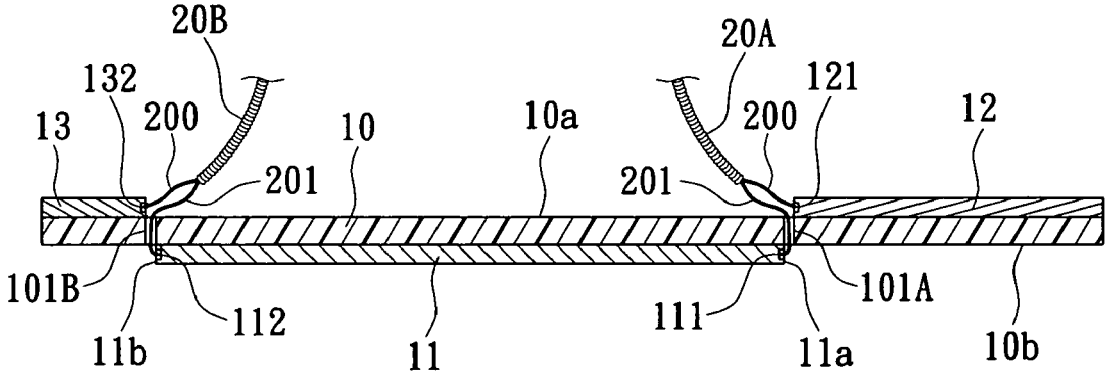
FIG. 6 shows the eighth embodiment of the dual-feed and dual-band antenna according to the present invention.

FIG. 6 shows the eighth embodiment of the non-coplanar antenna structure. In this embodiment, the grounding unit 11 is disposed on the bottom surface 10*b* of the substrate 10, and the first radiating unit 12 and the second radiating unit 13 are disposed on the top surface 10*a* of the substrate 10. Physically, the first radiating unit 12 and the second radiating unit 13 are respectively disposed in close proximity to the first side 11*a* and the second side 11*b* of the grounding unit 11. The substrate 10 preferably has a first hole 101A and a second hole 101B. One of the central conductor 200 and the outer grounding conductor 201 of the first coaxial cable 20A penetrates the first hole 101A so that the central conductor 200 and the outer grounding conductor 201 of the first coaxial cable 20A are respectively connected to the first feeding point 121 of the first radiating unit 12 and the first grounding point 111 of the grounding unit 11. However, in FIG. 6, the outer grounding conductor 201 of the first coaxial cable 20A penetrates the first hole 101A to connect with the first grounding point 111 of the grounding unit 11. Similarly, one of the central conductor 200 and the outer grounding conductor 201 of the second coaxial cable 20B penetrates the second hole 101B so that the central conductor 200 and the outer grounding conductor 201 of the second coaxial cable 20B are respectively connected to the second feeding point 132 and the second grounding point 112. In the figure, the outer grounding conductor 201 of the second coaxial cable 20B penetrates the second hole 101B to connect with the second grounding point 112 of the grounding unit 11. Please know that the non-coplanar antenna structure is not restricted in FIG. 6, and the first radiating unit 12 and the second radiating unit 13 can selectively disposed on the different surfaces of the substrate 10 depending on the applications or manufacturing processes.

To sum up, the dual-feed and dual-band antenna 1 has the following advantages.

1. The dual-feed and dual-band antenna 1 can be used in two bands and the switch circuit for the traditional dual-band antenna is not necessary for the dual-feed and dual-band antenna 1 of the present invention. Thus the performance of the antenna is maintained and the dual-feed and dual-band antenna 1 is applied to multi-module application.

2. The size of the grounding unit of the dual-feed and dual-band antenna 1 of the present invention is so small that the size of the electronic device can further reduced. The dual-feed and dual-band antenna 1 is more suitably assembled inside the case of diversified communication devices.

3. The structure of the dual-feed and dual-band antenna 1 of the present invention is simplified and modular, and the cost for manufacturing the antenna 1 is reduced.

Although the present invention has been described with reference to the foregoing preferred embodiment, it shall be understood that the invention is not limited to the details thereof. Various equivalent variations and modifications may occur to those skilled in this art in view of the teachings of the present invention. Thus, all such variations and equivalent modifications are also embraced within the scope of the invention as defined in the appended claims.

What is claimed is:

1. A dual-feed and dual-band antenna, comprising:

an elongated substrate unit having a top surface and a bottom surface, a first end portion, a second end portion, and a middle portion, wherein the first end portion and the second end portion are opposite to each other along the long axis of the substrate unit;

a grounding unit having a first side and a second side disposed on the top surface of the middle portion of the substrate unit, wherein the first and the second sides are opposite to each other in a longitudinal direction;

a first radiating unit disposed in a substantially planar manner on the top surface of the first end portion of the substrate unit in close proximity to the first side of the grounding unit without establishing electrical connection therewith, the first radiating unit being operable in a first frequency band; and a second radiating unit disposed in a substantially planar manner on the top surface of the second end portion of the substrate unit in close proximity to the second side of the grounding unit, the second radiating unit being operable in a second frequency band, wherein the second radiating unit has a short-circuit strip on the top surface of the substrate unit and the short-circuit strip being electrically connected to the grounding unit.

2. The dual-feed and dual-band antenna according to claim 1, further comprising:

a first coaxial cable connected with the first radiating unit and the grounding unit; and a second coaxial cable connected with the second radiating unit and the grounding unit.

3. The dual-feed and dual-band antenna according to claim 2, wherein the first radiating unit has a first feeding point, the grounding unit has a first grounding point on the first side thereof corresponding to the first feeding point, the first coaxial cable has a central conductor and an outer grounding conductor, the central conductor and the outer grounding conductor of the first coaxial cable are respectively connected to the first feeding point and the first grounding point, the second radiating unit has a second feeding point, the grounding unit has a second grounding point on the second side thereof corresponding to the second feeding point, the second coaxial cable has a central conductor and an outer grounding conductor, the central conductor and the outer grounding conductor of the second coaxial cable are respectively connected to the second feeding point and the second grounding point.

4. The dual-feed and dual-band antenna according to claim 1, wherein the grounding unit is a polygonal structure having at least four sides and the first radiating unit and the second radiating unit are disposed in close proximity to two opposite sides of the grounding unit.

5. The dual-feed and dual-band antenna according to claim 1, wherein the grounding unit is circular or elliptical with a long and a short axis, and the first radiating and the second radiating units are disposed in close proximity to two ends of the long axis or short axis, wherein the first radiating unit and the second radiating unit resonate a first and a second operation bands, and the area of the grounding unit is smaller than half the wavelength of the lower frequency band of the first and the second operation bands.

6. The dual-feed and dual-band antenna according to claim 1, wherein the short-circuit strip is electrically connected to the second side of the grounding unit.

7. The dual-feed and dual-band antenna according to claim 1, wherein the second radiating unit and the short-circuit strip have at least one angle.

8. The dual-feed and dual-band antenna according to claim 1, wherein the first radiating unit is rectangular or elliptical.

9. The dual-feed and dual-band antenna according to claim 1, wherein the first radiating unit has at least one slot.

10. A dual-feed and dual-band antenna, comprising:

an elongated substrate unit having a top surface and a bottom surface, a first end portion, a second end portion and a middle portion, wherein the first end portion and the second end portion are opposite to each other along the long axis of the substrate unit;

a grounding unit having a first side and a second side selectively disposed on either surface of the middle portion of the substrate unit, wherein the first and the second sides are opposite to each other in a longitudinal direction;

a first radiating unit selectively disposed in a substantially planar manner on either surface of the first end portion of the substrate unit in close proximity to the first side of the grounding unit without establishing electrical connection therewith, the first radiating unit being operable in a first frequency band;

a second radiating unit selectively disposed in a substantially planar manner on either surface of the second end portion of the substrate unit in close proximity to the second side of the grounding unit, the second radiating unit being operable in a second frequency band, wherein the second radiating unit has a short-circuit strip on the top surface or the bottom surface of the substrate unit, the short-circuit strip being electrically connected to the grounding unit;

a first coaxial cable connected between the grounding unit and the first radiating unit; and a second coaxial cable connected between the grounding unit and the second radiating unit.

11. The dual-feed and dual-band antenna according to claim 10, wherein the substrate unit further has a first hole and a second hole.

12. The dual-feed and dual-band antenna according to claim 11, wherein the first radiating unit has a first feeding point, the grounding unit has a first grounding point on the first side, the first coaxial cable has a central conductor and an outer grounding conductor, one of the central conductor and the outer grounding conductor of the first coaxial cable penetrates the first hole so that the central conductor and the outer grounding conductor of the first coaxial cable are respectively connected to the first feeding point and the first grounding point, the second radiating unit has a second feeding point, the grounding unit has a second point on the second side, the second coaxial cable has a central conductor and an outer grounding conductor, one of the central conductor and the outer grounding conductor of the second coaxial cable penetrates the second hole so that the central conductor and the outer grounding conductor of the second coaxial cable are respectively connected to the second feeding point and the second grounding point.

13. The dual-feed and dual-band antenna according to claim 10, wherein the grounding unit is a polygonal structure having at least four sides and the first radiating unit and the second radiating unit are disposed in close proximity to two opposite sides of the grounding unit.

14. The dual-feed and dual-band antenna according to claim 10, wherein the grounding unit is circular or elliptical having a long and a short axis, and the first radiating and the second radiating units are disposed in close proximity to two ends of the long axis or short axis of the grounding unit, wherein the first radiating unit and the second radiating unit resonate a first and a second operation bands, and the area of the grounding unit is smaller than half the wavelength of the lower frequency band of the first and the second operation bands.

15. The dual-feed and dual-band antenna according to claim 10, wherein the short-circuit strip is electrically connected to the second side of the grounding unit.

16. The dual-feed and dual-band antenna according to claim 10, wherein the second radiating unit and the short-circuit strip have at least one angle.

17. The dual-feed and dual-band antenna according to claim 10, wherein the first radiating unit has at least one slot.

18. The dual-feed and dual-band antenna according to claim 10, wherein the first radiating unit is rectangular or elliptical.

* * * * *